US008302702B2

(12) United States Patent
Hansson et al.

(10) Patent No.: US 8,302,702 B2
(45) Date of Patent: Nov. 6, 2012

(54) TORQUE SENSING UNIT FOR A POWER TOOL AND A POWER TOOL COMPRISING SUCH A TORQUE SENSING UNIT

(75) Inventors: Christer Gunnar Hansson, Stockholm (SE); Erik Vilhelm Persson, Täby (SE)

(73) Assignee: Atlas Copco Tools AB, Nacka (SE)

( * ) Notice: Subject to any disclaimer, the term of this patent is extended or adjusted under 35 U.S.C. 154(b) by 327 days.

(21) Appl. No.: 12/667,615

(22) PCT Filed: Jun. 13, 2008

(86) PCT No.: PCT/SE2008/000394

§ 371 (c)(1),
(2), (4) Date: Jan. 26, 2010

(87) PCT Pub. No.: WO2009/005435

PCT Pub. Date: Jan. 8, 2009

(65) Prior Publication Data

US 2011/0000694 A1 Jan. 6, 2011

(30) Foreign Application Priority Data

Jul. 5, 2007 (SE) ..... 0701621

(51) Int. Cl.
*B25B 23/14* (2006.01)

(52) U.S. Cl. ..... 173/182; 173/180; 173/5

(58) Field of Classification Search ..... 173/182, 173/180, 5

See application file for complete search history.

(56) References Cited

U.S. PATENT DOCUMENTS

| | | | | |
|---|---|---|---|---|
| 3,920,082 | A | 11/1975 | Dudek | |
| 4,006,784 | A | 2/1977 | Dudek | |
| 4,043,222 | A | 8/1977 | Dudek | |
| 4,281,538 | A | 8/1981 | Dudek | |
| 4,404,799 | A | 9/1983 | Dudek | |
| 4,427,077 | A * | 1/1984 | Hall | 173/183 |
| 4,620,449 | A | 11/1986 | Borries et al. | |
| 5,014,793 | A * | 5/1991 | Germanton et al. | 173/181 |
| 5,170,852 | A * | 12/1992 | Shikata et al. | 173/181 |
| 5,172,774 | A | 12/1992 | Melrose | |
| 5,181,575 | A * | 1/1993 | Maruyama et al. | 173/180 |
| 2010/0147545 | A1 * | 6/2010 | Hirt et al. | 173/182 |

FOREIGN PATENT DOCUMENTS

WO WO 2008/090069 A1 7/2008

OTHER PUBLICATIONS

English Language International Search Report dated Oct. 7, 2008 issued in parent Appln. No. PCT/SE2008/000394.

* cited by examiner

*Primary Examiner* — Brian D Nash
(74) *Attorney, Agent, or Firm* — Holtz, Holtz, Goodman & Chick, PC

(57) ABSTRACT

A torque sensing unit for a power tool arranged to generate a torque responsive signal by sensing the reaction torque transferred from a ring gear of a planetary reduction gearing to the tool housing. The torque sensing unit includes an annular torque transferring element disposed perpendicularly to the geometric axis of the ring gear and being formed with a first pair of external engagement portions for connecting the torque transferring element to the housing, a second pair of external engagement portions for connecting the torque transferring element to the ring gear, and at least one pair of weak elastically deformable zones located between the engagement portions and provided with sensors for delivering signals in response to the transferred reaction torque.

16 Claims, 1 Drawing Sheet

TORQUE SENSING UNIT FOR A POWER TOOL AND A POWER TOOL COMPRISING SUCH A TORQUE SENSING UNIT

CROSS-REFERENCE TO RELATED APPLICATIONS

This application is a U.S. National Phase Application under 35 USC 371 of International Application PCT/SE2008/001394 filed Jun. 13, 2008.

BACKGROUND OF THE INVENTION

1. Field of the Invention

The invention concerns a torque sensing unit and a power tool provided with such torque sensing unit by which an output torque responsive signal is generated by a means sensing the reaction torque transferred from a part of a reduction gearing to the tool housing.

In particular, the invention relates a torque sensing unit comprising a reaction torque transferring element connected between a ring gear of a planetary reduction gearing and the tool housing and provided with strain sensors arranged to deliver signals in response to the transferred reaction torque and, hence, the output torque of the tool.

2. Description of the Related Art

One previously known type of torque sensing means is described in for instance U.S. Pat. No. 4,620,449 and comprises an elastically deformable sleeve connecting a ring gear of the reduction gearing to the tool housing, and a strain gauge type sensor means arranged to indicate elastic torsional deformation of the sleeve responsive to the reaction torque transferred to the tool housing. This device is disadvantageous in that it requires a substantial axial space in the tool housing. It is also relatively costly to produce.

Another type of torque sensing means for a torque delivering power tool is described in U.S. Pat. No. 5,172,774. This known torque sensing means comprises a wheel shaped torque transferring element which comprises a hub formed with internal splines for connection to an immobile disc mounted in the housing, and a rim portion formed with external splines for connection to a ring gear element exposed to a reaction torque. This device is advantageous in that it requires a relatively short axial space in the tool housing, but instead it requires a large radial space and is rather complicated and expensive to manufacture.

BRIEF SUMMARY OF THE INVENTION

It is a primary object of the invention to accomplish an improved torque sensing unit and a power tool provided with such torque sensing unit by which the drawbacks of the prior art devices are avoided. Accordingly, the invention intends to create a torque sensing unit for a power tool that is compact in design and simple and non-expensive to manufacture.

Further advantages and objects of the invention will appear from the following specification and claims.

A preferred embodiment of the invention is below described in detail with reference to the accompanying drawing.

DETAILED DESCRIPTION OF THE INVENTION

Figure 1:
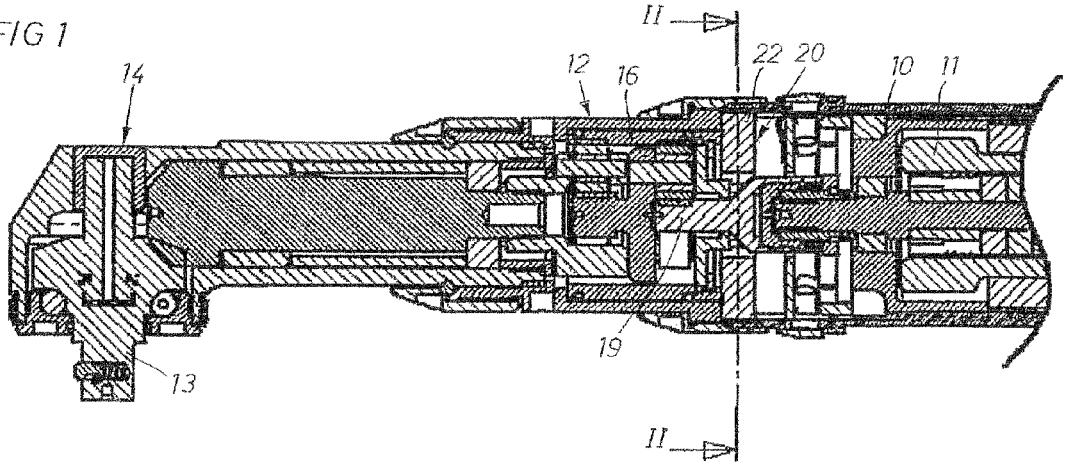
FIG. 1 shows a longitudinal section through a power tool comprising a torque sensing unit according to the invention.

The power tool illustrated in the drawing figures is a power nutrunner for tightening screw joints and comprises a housing 10, a rotation motor 11, a reduction gearing 12, and an output shaft 13 journalled in an angle head 14. The reduction gearing 12 comprises two planetary gearings of a well known type connected in series and having a common non-rotating ring gear 16 connected to the housing 10. In order to keep down the volume of the specification the planetary gearings are not described in further detail. However, the reduction gearing 12 has a primary drive shaft formed with a sun gear 19 and connected to the motor 11.

The ring gear 16 is connected to the housing 10 via a torque sensing unit 20 arranged to transfer to the housing 10 the reaction torque exerted on the ring gear 16 during operation of the tool.

As well known in prior art, the reaction torque exerted on a ring gear of a planetary reduction gearing is proportional to the output torque delivered via the output shaft of the tool, and in order to accomplish a stationary relatively simple means to measure the output torque of the tool a torque sensing means has been employed between the ring gear and the tool housing. As described above previously known devices for this purpose have been disadvantageous by being too space demanding and/or too complicated and expensive to manufacture.

In the power tool illustrated in the drawing figures a torque sensing unit 20 including an annular torque transferring element 22 is connected between the ring gear 16 and the housing 10 and has a geometric axis coinciding with the geometric axis of the ring gear 16. This torque transferring element 22 is relatively thin, i.e. its axial length is considerably less than its radial dimensions, which means that it requires a limited axial space only of the inside area of the housing 10. The torque transferring element 22 is formed with a first pair of external and diametrically opposite engagement portions 24,25 for connection to the housing 10, and a second pair of diametrically opposite engagement portion 27,28 for connection to the ring gear 16. The first pair of engagement portions 24,25 is angularly spaced by 90 degrees relative to the second pair of engagement portions 27,28.

The first pair of engagement portions 24,25 is intended to transfer reaction forces $F_R$ from the torque transferring element 22 to the housing 10, whereas the second pair of engagement portions 27,28 is intended to transfer torque related tangentially directed forces $F_T$ received from the ring gear 16 to the torque transferring element 22. See FIG. 3.

Figure 2:
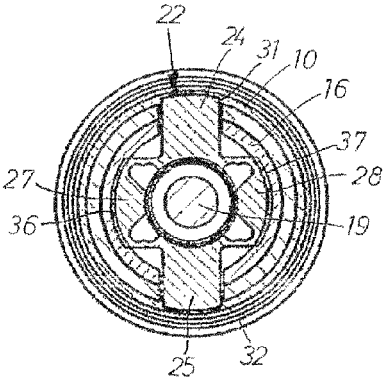
FIG. 2 shows a cross section along line II-II in FIG. 1.

The engagement portions 24,25 of the first pair are adapted to engage grooves 31,32 in the housing 10, and the engagement portions 27,28 of the second pair are adapted to cooperate with pockets 36,37 in the ring gear 16. See FIG. 2.

Figure 3:
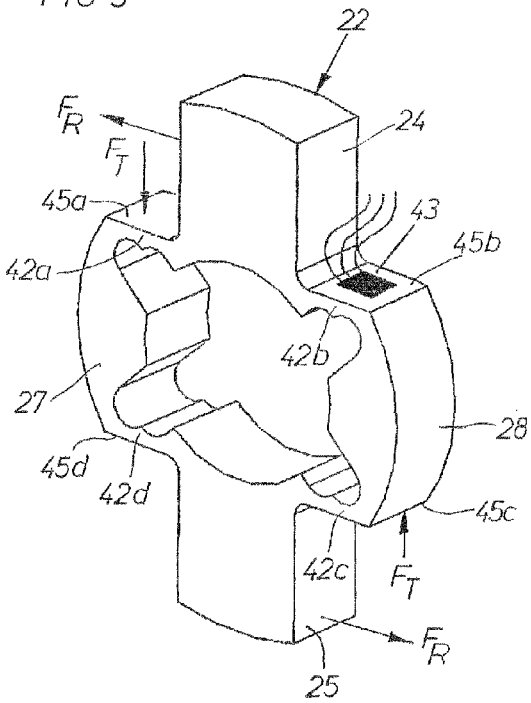
FIG. 3 shows a perspective view of a torque transferring element according to the invention including a strain sensing means.

Between the first and second pairs of engagement portions 24,25 and 27,28, respectively, there are four identical weak zones 42 *a-d* which during torque transfer are exposed to bending stresses, thereby being elastically deformed. In order to measure this deformation caused by the bending stresses there are provided strain gauges 43, of which just one is illustrated in FIG. 3. These strain gauges 43 are mounted on flat surfaces 45 *a-d* which extend in planes A and B which are parallel to the geometric axis C of the ring gear 16. In the transverse direction these planes A and B extend along chord lines of an imaginary circle coaxial with the ring gear 16.

Suitably, each strain gauge 43 is connected in a Wheatstone Bridge circuit of an operation control or monitoring means, located onboard the power tool or at a distance from the tool as a stationary unit, whereby torque related signals are obtained for indicating the output torque of the tool. By comparing the actual signals with a predetermined set signal representing a desired final torque level it is possible to determine when the delivered output torque has reached a desired level or not and, if desired, initiate an automatic power tool shut-off.

Thanks to its compact dimensions and simple design the torque sensing unit according to the invention is not only suitable for but particularly adapted to power tool application. The annular torque transferring element 22 may be rationally manufactured by extrusion technique where for instance a light alloy tube shaped blank with the desired cross sectional shape is extruded, and separate elements are formed by cutting that blank into "slices".

The invention claimed is:

1. A torque sensing unit for a power tool having a housing, a rotation motor, and a planetary reduction gearing with a ring gear, the torque sensing unit comprising:

a torque transferring element interposed between the ring gear and the housing for transferring a reaction torque exerted on the ring gear to the housing, the torque transferring element including at least one strain sensor for delivering electric signals in response to the transferred reaction torque magnitude, and wherein:

the torque transferring element is substantially annular in shape and has an axial length substantially smaller than its radial dimensions, the torque transferring element is arranged with its geometric axis coinciding with the geometric axis of the ring gear; and wherein the torque transferring element further comprises:

a first pair of external engagement portions for co-operation with grooves in the housing;

a second pair of external engagement portions for co-operation with pockets in the ring gear, said first and second pairs of engagement portions being angularly spaced relative to each other; and at least one pair of weak deformation zones located between said first and second pairs of engagement portions and arranged to be exposed to bend stresses by the reaction torque transferred by the torque transferring element, and wherein said at least one strain sensor is attached to one of said deformation zones.

2. The torque sensing unit according to claim 1, wherein:

each one of said deformation zones comprises a flat surface extending in a plane substantially parallel with the geometric axis of the ring gear; and said at least one strain sensor comprises a strain gauge mounted on said flat surface of at least one of said deformation zones.

3. The torque sensing unit according to claim 2, wherein:

said at least one deformation zone comprises four deformation zones which are arranged in two pairs, with the deformation zones of one pair located diametrically opposite to the deformation zone of the other pair; and said two pairs of deformation zones are located at a 90 degree angular spacing relative to each other.

4. The torque sensing unit according to claim 3, wherein:

said engagement portions of said first pair are located diametrically opposite each other;

said engagement portions of said second pair are located diametrically opposite each other; and the engagement portions of said first pair are angularly spaced from the engagement portions of said second pair by 90 degrees.

5. The torque sensing unit according to claim 4, wherein said torque transferring element is a one-piece body.

6. The torque sensing unit according to claim 2, wherein:

said engagement portions of said first pair are located diametrically opposite each other;

said engagement portions of said second pair are located diametrically opposite each other; and the engagement portions of said first pair are angularly spaced from the engagement portions of said second pair by 90 degrees.

7. The torque sensing unit according to claim 6, wherein said torque transferring element is a one-piece body.

8. The torque sensing unit according to claim 2, wherein said torque transferring element is a one-piece body.

9. The torque sensing unit according to claim 3, wherein said torque transferring element is a one-piece body.

10. The torque sensing unit according to claim 1, wherein:

said at least one deformation zone comprises four deformation zones which are arranged in two pairs, with the deformation zones of one pair located diametrically opposite to the deformation zone of the other pair; and said two pairs of deformation zones are located at a 90 degree angular spacing relative to each other.

11. The torque sensing unit according to claim 10, wherein:

said engagement portions of said first pair are located diametrically opposite each other;

said engagement portions of said second pair are located diametrically opposite each other; and the engagement portions of said first pair are angularly spaced from the engagement portions of said second pair by 90 degrees.

12. The torque sensing unit according to claim 11, wherein said torque transferring element is a one-piece body.

13. The torque sensing unit according to claim 10, wherein said torque transferring element is a one-piece body.

14. The torque sensing unit according to claim 1, wherein:

said engagement portions of said first pair are located diametrically opposite each other;

said engagement portions of said second pair are located diametrically opposite each other; and the engagement portions of said first pair are angularly spaced from the engagement portions of said second pair by 90 degrees.

15. The torque sensing unit according to claim 14, wherein said torque transferring element is a one-piece body.

16. The torque sensing unit according to claim 1, wherein said torque transferring element is a one-piece body.

* * * * *